United States Patent [19]

Stevens

[11] 4,048,023

[45] Sept. 13, 1977

[54] ELECTRODEPOSITION OF GOLD-PALLADIUM ALLOYS

[75] Inventor: Peter Stevens, Parsippany, N.J.

[73] Assignee: Oxy Metal Industries Corporation, Warren, Mich.

[21] Appl. No.: 694,278

[22] Filed: June 9, 1976

[51] Int. Cl.[2] ..... C25D 3/56; C25D 3/62

[52] U.S. Cl. ..... 204/44; 204/43 G; 204/43 N

[58] Field of Search ..... 204/43 G, 44, 46 G, 204/123, 43 N; 106/1

[56] References Cited

FOREIGN PATENT DOCUMENTS 534,215 4/1973 Switzerland ..... 204/44

*Primary Examiner*—G. L. Kaplan

*Attorney, Agent, or Firm*—B. F. Claeboe; Arthur E. Kluegel

[57] ABSTRACT

A slightly alkaline gold plating solution, free of cyanide and phosphates, contains a sodium gold sulfite complex and a palladosamine chloride complex.

8 Claims, No Drawings

ELECTRODEPOSITION OF GOLD-PALLADIUM ALLOYS

BACKGROUND OF THE INVENTION

Swiss Expose D'Invention No. 534,215 describes an electrolytic bath for the electrodeposition of gold alloys which is cyanide free and contains gold as an alkali gold sulfite and palladium as a palladium coumpound soluble in the bath. The palladium compunds therein disclosed include palladium salts soluble in the bath such as the chlorides which are complexed with either ammonia or an aliphatic amine, a cycloaliphatic amine, a heterocyclic amine, or a polyamine. It has been found, however, that use of the palladium complexes described in the Swiss Expose D'Invention yield a gold coating which exhibits a haze. Surprisingly, it has been found that when palladosamine chloride is used in place of the palladium complexes described in the Swiss Expose D'Invention, a gold coating can be obtained without the haze.

It is the object of this invention to provide a gold electroplating solution, free of cyanides and phosphates, which eliminates, in the resulting coating, the haze exhibited by the coatings of the prior art. This and other objects of the invention will become apparent to those of ordinary skill in the art from the following detailed description.

SUMMARY OF THE INVENTION

This invention relates to a gold electroplating solution and more particularly to a solution free of cyanide and phosphate which contains a sodium gold sulfite complex and a palladosamine chloride complex.

DESCRIPTION OF THE PREFERRED EMBODIMENTS

The electroplating bath of the instant invention can contain the same ingredients as disclosed in the aforementioned Swiss Expose D'Invention No. 534,215 except that the palladium is employed as palladosamine chloride. Thus, the gold concentration in the bath can be 1 to 50 grams per liter and that of the palladium can be 0.05 to 10 grams per liter, and the bath can additionally contain, if desired, at least one additional metal from the group of Bi, Cu, Ni, Ag, Co, Mn, Zn, Cd, In, Sn, Pb, Sb and As in the form of their soluble compounds having concentrations between 10 milligrams per liter and 30 grams per liter.

In addition, the bath can contain the usual chelation agents for metal ions, e.g. citric, tartaric, malic, gluconic, oxalic and other acids at a concentration of 1 gram per liter to saturation.

The bath can further contain ingredients for modifying its mechanical properties such as glycerine and polyethylene glycol, which steady the motion of the liquid which contacts the substrates to be plated. Brightening agents such as selenium or sulfur compounds as well as solution conductability additives such as ammonia, alkali metal salts and alkaline earth metal salts, can also be present.

The additives set forth In U.S. Pat. Nos. 3,644,184 and 3,787,463, hereby incorporated by reference, can also be used.

The electroplating bath can be operated at a pH of about 5.5 to 11 and maintained at the pH chosen by use of a buffereing agent. For this purpose, most common buffering agents can be used, for example, the alkali metal borates, phthalates, citrates and the like. Although alkali metal phosphate buffers can be used, it is preferred to avoid the use of phosphates in the instant bath.

The electroplating bath of this invention is used to electrolytically coat gold-palladium alloys on substrates which conduct electricity or which have been caused to conduct electricity. The bath can be operated at a temperature of about 20° to 85° C and about 0.1 to 3 A/dm$^2$.

The gold-palladium alloy coatings obtained by means of the present bath can contain, depending on the ion concentration in the bath, about three to fifty weight percent palladium. These limits are, however, not critical and higher or lower palladium contents are also possible. The coatings have a grey color. When the coatings also contain copper (derived from, e.g., Cu $SO_4$, Cu $Cl_2$, Cu $(C_2H_3O_2)_2$, Cu $(NO_3)_2$ and the like), they exhibit a grey-pink "transparent" color which is difficult to imitate by other electrolytic means. Their ductility, hardness and brilliance are exceptionally good and the coatings are not hazy.

A typical electroplating bath in accordance with the present invention is formulated by mixing the following ingredients in water: palladosamine chloride (1.8 g/l), sodium gold sulfite (10 g/l), ammonium sulfite (15 g/l), copper sulfate (0.095 g/l), and sodium arsenite (0.03 g/l). The pH was adjusted to 8.2 with NaOH and the bath operated at a temperature of 56° to 58° C. At a current density of 5 amperes per square foot and a plating rate of 100 milligrams per ampere minute, a fully bright, flesh toned gold deposit was obtained.

Various changes and modifications can be made in the electroplating bath of the present invention without departing from the spirit and scope thereof. The various embodiments set forth herein were for the purpose of further illustrating the invention but were not intended to limit it.

I claim:

1. In an aqueous gold electroplating bath, free of cyanides and containing about 1 to 50 g/l of gold as an alkali metal gold sulfite and about 0.05 to 10 g/l of palladium as a complex, the improvement which comprises employing palladosamine chloride as the palladium complex and wherein said bath is buffered to a pH within the range of about 5.5 to 11.

2. An aqueous gold electroplating bath as defined in claim 1, in which the bath is buffered to a pH of about 8.2.

3. An aqueous gold electroplating bath as defined in claim 1, in which the bath additionally contains a soluble copper compound.

4. An aqueous gold electroplating bath as defined in claim 3, in which the copper compound is present in a concentration of about 10 milligrams per liter to 30 grams per liter.

5. An aqueous gold electroplating bath as defined in claim 3, in which the alkali metal gold sulfite is sodium gold sulfite and the copper compound is copper sulfate.

6. A process for producing a gold electroplated substrate which comprises contacting the substrate with the aqueous cyanide-free electroplating bath of claim 1, and then passing electrical current through said bath so as to deposit a gold coating on said substrate.

7. A process as defined in claim 6, wherein the gold concentration is about 1–50 g/l, the palladium concentration is about 0.5–10 g/l, the bath is buffered to a pH of about 7.5–11, the bath temperature is about 20°–85° C, and the current density at the cathode is about 0.1–3 A/dm$^2$.

8. A process as defined in claim 7, wherein said bath additionally contains a soluble copper compound at a concentration of about 10 mg/l to 30 g/l.

* * * * *